US008413711B2

(12) United States Patent
Vaagland et al.

(10) Patent No.: US 8,413,711 B2
(45) Date of Patent: Apr. 9, 2013

(54) ARRANGEMENT RELATED TO EQUIPMENT FOR CONTINUOUS OR SEMI-CONTINUOUS CASTING OF METAL

(75) Inventors: Bjørn Vaagland, Sunndalsøra (NO); John Olav Fagerlie, Sunndalsøra (NO); John Erik Hafsås, Sunndalsøra (NO); Arild Håkonsen, Sunndalsøra (NO); Geir Øyen, Furugrenda (NO); Terje Iveland, Sunndalsøra (NO)

(73) Assignee: Norsk Hydro ASA, Oslo (NO)

( * ) Notice: Subject to any disclaimer, the term of this patent is extended or adjusted under 35 U.S.C. 154(b) by 0 days.

(21) Appl. No.: 12/745,601

(22) PCT Filed: Nov. 26, 2008

(86) PCT No.: PCT/NO2008/000424

§ 371 (c)(1),
(2), (4) Date: Nov. 12, 2010

(87) PCT Pub. No.: WO2009/072893

PCT Pub. Date: Jun. 11, 2009

(65) Prior Publication Data

US 2011/0048667 A1 Mar. 3, 2011

(30) Foreign Application Priority Data

Dec. 3, 2007 (NO) ..... 20076224

(51) Int. Cl.
*B22D 11/049* (2006.01)
*B22D 11/10* (2006.01)

(52) U.S. Cl. ..... 164/487; 164/437; 164/444; 164/488; 222/590; 222/591

(58) Field of Classification Search ..... 164/437, 164/444, 487, 488; 222/590, 591
See application file for complete search history.

(56) References Cited

U.S. PATENT DOCUMENTS

| | | | | |
|---|---|---|---|---|
| 3,367,396 | A * | 2/1968 | Stich et al. | 164/474 |
| 3,552,478 | A | 1/1971 | Lauener | |
| 3,653,426 | A * | 4/1972 | Groteke et al. | 164/257 |
| 5,056,692 | A * | 10/1991 | Wilford et al. | 222/590 |
| 7,445,037 | B2 * | 11/2008 | Heggset et al. | 164/487 |
| 2006/0219378 | A1 * | 10/2006 | Heggset et al. | 164/15 |

* cited by examiner

FOREIGN PATENT DOCUMENTS

| | | |
|---|---|---|
| GB | 1082413 | 9/1967 |
| WO | 2005/000500 | 1/2005 |

OTHER PUBLICATIONS

International Search Report issued Feb. 25, 2009 in International (PCT) Application No. PCT/NO2008/000424.

*Primary Examiner* — Devang R Patel
(74) *Attorney, Agent, or Firm* — Wenderoth, Lind & Ponack, L.L.P.

(57) ABSTRACT

A device in connection with equipment for continuous or semi-continuous casting of metal, in particular direct mold (DC) casting of aluminum in the form of a billet or wire billet. The device includes a mold with a cavity or a mold (3) that is provided with an inlet connected, via supply channels (6, 18) and a distribution chamber (5), to a metal reservoir (13) and an outlet arranged in the mold with a support and devices for cooling the metal. In connection with the supply channels (6, 18) between the metal reservoir (13) and the molds (3), a metal lifting container (15) is arranged at an inlet (16) to the metal reservoir (13) via a channel (18) and to the distribution chamber (5) and the molds (3) via an outlet (17) via another channel (6). The metal lifting container is sealed from the surroundings and has a connection socket (19) for connection to a vacuum source so that, when a casting operation starts, metal is sucked into the metal lifting container and lifted to a level that is higher than the level of the distribution chamber (5) above the molds (3).

8 Claims, 2 Drawing Sheets

ARRANGEMENT RELATED TO EQUIPMENT FOR CONTINUOUS OR SEMI-CONTINUOUS CASTING OF METAL

BACKGROUND OF THE INVENTION

1. Technical Field

The present invention concerns an arrangement in connection with equipment for continuous or semi-continuous casting of metal, in particular direct mold (DC) casting of aluminium, comprising a mold with a cavity or a mold that is provided with an inlet connected to a metal reservoir and an outlet with devices for cooling metal so that an object is cast via the outlet in the form of a billet or a wire billet.

2. Description of the Related Art

Equipment of the above type is generally known and used for casting alloyed or unalloyed metal used in the further processing of the metal downstream in the production chain, for example for remelting and extrusion purposes.

A main challenge for this type of prior art casting equipment has been to achieve a segregation-free, smooth surface on the cast product. This has been particularly important for products in which the surface is not removed before further shaping. Surface segregation is assumed to be caused by two main phenomena, inverse segregation and sweating.

When the metal comes into contact with the mold, solidification begins in a thin layer. This solidification will normally take place out from the mold and in towards the center of the billet. When the metal goes from liquid to solid phase, the external volume will decrease and this must be refilled with alloyed melt from areas further in. This produces solidification that is called inverse because the segregation takes place against the solidification front. This type of segregation typically produces a thin alloyed zone under the surface of the billet that is 10-20% higher in alloy element than the normal alloy content.

The second phenomenon, sweating, occurs when the solidified shell on the outside of the billet is not in physical contact with the mold wall. Alloyed metal can then be pressed out through the solidified shell (melting up) or partially solidified shell. This solidification produces a thin, highly alloyed zone outside the original surface and a correspondingly depleted zone under the original surface.

Inverse segregation and sweating are assumed, in turn, to be affected by a number of factors such as heat transfer from billet to mold walls, the length of the contact zone between mold and billet and grain refinement and solidification morphology, etc.

Moreover, to reduce segregation, it is important, among other things, to reduce heat transfer between mold and billet, to reduce the metal level above or in the mold, to reduce fluctuations in the metal level (produces less segregation and variation in the surface topography) and to avoid periodic fluctuations in the contact area on account of varying gas pressure and volume inside hot top molds, which produce the characteristic rings seen on the surface of billets.

One method that is in daily use and can result in a billet without surface segregation is electromagnetic casting, but this method is demanding in terms of investment and control systems. With electromagnetic casting, the pressure differences over the shell are eliminated, i.e. the sweating disappears. At the same time there is no contact between metal and mold wall. Therefore, no inverse segregation zone is formed either.

Using conventional casting technology, it is possible to reduce both sweating and inverse segregation by reducing the effect of the mold's contact with the metal.

In another method for which a patent was applied for by the applicant, which is shown and described in WO 2005/000500 and in which a hot top is used with supply devices for gas and oil in the solidification area for the metal, the contact area with the mold and the heat transfer to it are reduced. Thus, a small inverse segregation zone will be obtained. In this casting method, the metal is also supplied in such a way that the metallostatic pressure is close to zero or is zero, thus eliminating sweating.

SUMMARY OF THE INVENTION

With the present invention, a method has been arrived at for continuous or semi-continuous casting of metal based on the principle in accordance with the applicant's above-mentioned WO application but in which the supply of metal to the molds, in particular during the start phase, has been considerably simplified. The casting shoe is filled faster, the casting quickly enters low-pressure casting mode and the quantity of residual metal after casting has been considerably reduced. Moreover, a solution has been arrived at that simplifies the adjustment of the metal level in the mold(s), i.e. the metal level in relation to primary and secondary cooling, so that it is possible, in a simple manner, to adapt the casting operation to the alloy to be cast.

BRIEF DESCRIPTION OF THE DRAWINGS

The present invention will be described in further detail in the following using examples and with reference to the attached figures, where.

DETAILED DESCRIPTION OF THE INVENTION

Figure 1:
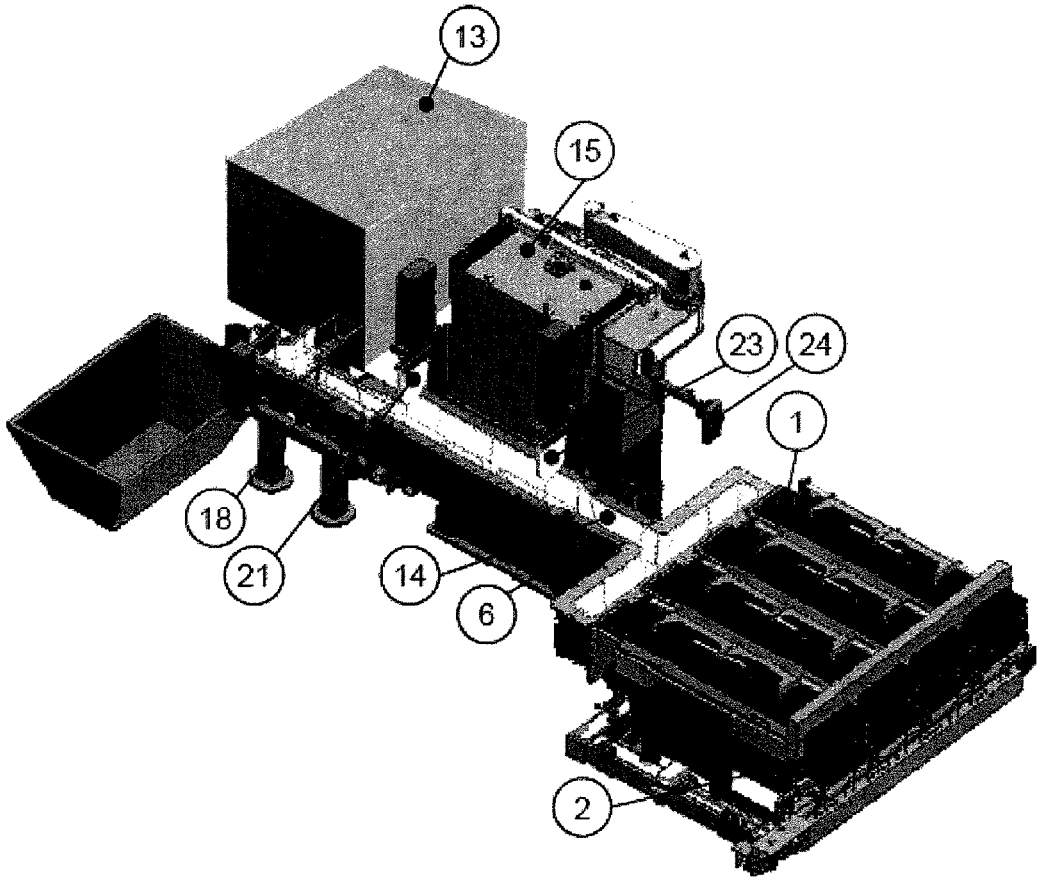
FIG. 1 shows, in perspective, partially from the side and from the front, simple casting equipment with a device for supplying metal in accordance with the present invention.

As stated, FIG. 1 shows, in perspective, an example of simple casting equipment 1 in accordance with the present invention for DC casting of billets. It is simple in the sense that it here only comprises six molds or molds 3 (see also FIG. 2) with metal inlets 4. This type of equipment can comprise many more molds, up to a few hundred depending on their diameter, among other factors, and can have the capacity to cast several tens of tonnes of metal per hour.

In rough terms, the equipment comprises, in addition to the molds, which are not shown in FIG. 1, a frame structure 2 with a thermally insulated channel system 6 for the supply of metal from a metal reservoir (holding furnace or similar) 13 and a correspondingly insulated distribution chamber (metal manifold) 5 for distributing the metal to the respective molds. Above the distribution chamber 5, the equipment has a removable lid or cover 7 that is designed to keep the distribution chamber sealed from the surroundings. Air ducts 9 (see FIG. 2) that emerge in other pipe sockets 12 with a closing device 10 are connected to the cavity 11 in the mold 3.

Figure 2:
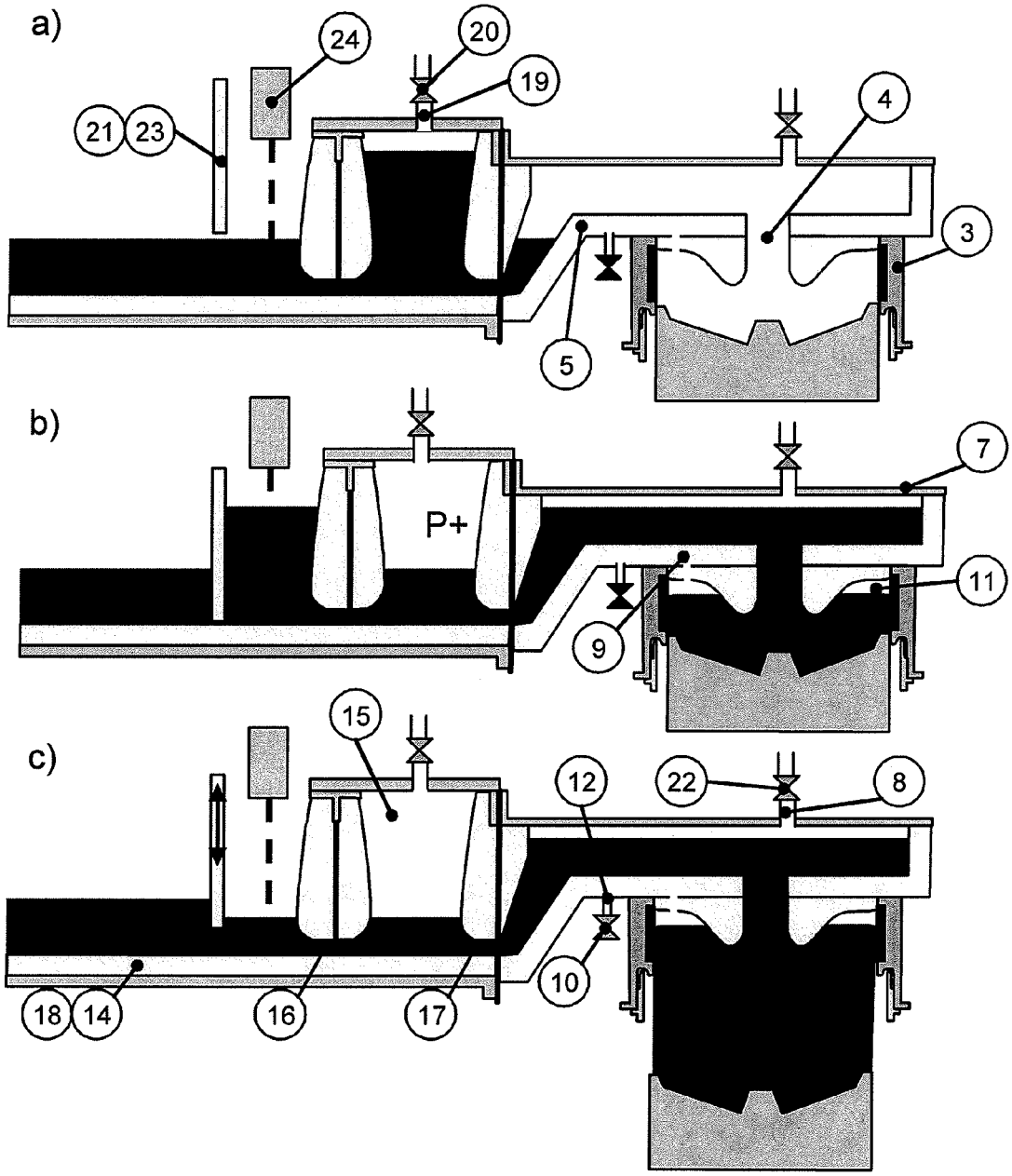
FIGS. 2 *a*), 2 *b*) and 2 *c*) show, in longitudinal section and in larger scale, three sequences of the supply part, including a mold that is included in the casting equipment shown in FIG. 1.

The special feature of the present invention, in addition to the features described in the applicant's above WO patent application, consists in the fact that, as shown in FIG. 1 and FIG. 2, a metal lifting container 15 is arranged in connection with the supply channels 6, 18 between the metal reservoir 13 and the molds 3. Like the channels 6, 18 and the distribution chamber 5 for the molds, the metal lifting container is thermally insulated using an appropriate insulating material 14 and is connected at one or more inlets 16 to the metal reservoir 13 via the channel 18 and to the molds 3 via one or more outlets 17 via the channel 6. The metal lifting container is otherwise sealed from the surroundings but has a connection socket 19 for vacuum so that metal can be sucked into the metal lifting container and lifted to a level that is higher than the level of the distribution chamber 5 above the molds 3. The metal lifting container has a volume that is preferably somewhat higher than the volume of metal that is necessary to fill the distribution chamber and the molds in connection with the casting operation being started. The purpose of the metal lifting container is to lift the metal to a higher level to fill the casting shoe and thus establish transportation of metal to the casting molds based on the siphon principle. The method of operation of the metal lifting container is as follows: with semi-continuous DC casting of, for example, billets, as shown in the figures, the metal is cast in defined lengths (rods) and the supply of metal from the reservoir 13 is closed before the remaining metal is removed after each casting operation. When a new casting operation is started, the supply of metal to the channels 6, 18 is thus opened so that liquid metal is supplied to them and also flows through the metal lifting container 15. The metal lifting container is now placed under a vacuum (appropriate negative pressure) via the suction socket 19 by opening a valve 20 that is arranged in connection with the suction socket. The metal is then sucked from the metal reservoir 13 into the metal lifting container to a higher level as shown in FIG. 2 *a*) and a metal lock 21 arranged in the channel 18 in front of the metal lifting container is open. After the metal has been sucked to a sufficiently high level in the metal suction container, the metal lock 21 is closed. The negative pressure in the metal lifting container is then reduced so that the metal flows to the molds 3 via the channel 6 and the distribution chamber 5, as shown in FIG. 2 *b*). At this time (cf. FIG. 2 *b*) the metal level in the channel 6 and the distribution chamber 5 is higher than in the channel 18.

When the casting shoe is full of metal, the casting operation itself starts by the casting shoe (the mold support) being lowered. The level in the channel 6 is thus reduced. At the same time, a negative pressure is established in the distribution chamber 5 by a negative pressure being applied to the chamber from the vacuum source via the connection socket 8 with the valve 22 so that the supply of metal to the distribution chamber and thus the molds is maintained by means of the stated siphon principle.

When the level in the channels 6 and 18 is almost equal, the metal lock 21 is opened as shown in FIG. 2 *c*) so that the metal flows from the metal reservoir 13 via the channels and the lifting container to the molds. When the metal lock 21 opens, the adjustment of the metal level in the channel 6 starts by means of a lock 23 arranged on the opposite side of the lifting container in relation to the lock 21. In the example shown here, a lock 23 is used to adjust the metal level. However, other valve or closing devices can also be used to adjust the level, for example a nozzle/pin solution.

When the level in the channel 6 has reached the desired height in relation to the metal casting height in the mold(s), the valve 10 is opened to vent the mold(s) against the surroundings or against another desired counterpressure reservoir. From this time, the metal level in the mold is adjusted by adjusting the metal level in the channel 6 using the lock 23 on the basis of level measurements using a level detector 24 that can be a laser detector or the like. The casting takes place otherwise as shown and described in the applicant's above mentioned WO 2005/000500.

The invention claimed is:

1. A device for continuous or semi-continuous casting of metal, the device comprising:

a metal reservoir;

a metal lifting container having an inlet that is connected to the metal reservoir via a first supply channel;

at least one mold provided with an inlet and an outlet;

a distribution chamber for distributing metal to the mold, wherein the inlet of the mold is connected to the metal lifting container via the distribution chamber and a second supply channel; and a movable support and at least one metal cooling device arranged at the outlet of the mold, wherein the metal reservoir, the metal lifting container, and the distribution chamber are interconnected in series one after the other, and wherein the metal lifting container is sealed from the surroundings and has a connection socket for connection to a vacuum source so that, when a casting operation starts, metal can be sucked into the metal lifting container and lifted to a level that is higher than a level of the distribution chamber above the mold.

2. The device in accordance with claim 1, wherein the metal lifting container has a volume equivalent at least to a quantity of metal necessary to fill the distribution chamber and the molds.

3. The device in accordance with claim 1, wherein on each side of the metal lifting container in connection with the first and second supply channels, metal locks are arranged to shut off or adjust the metal throughflow and the level in the first and second supply channels in connection with a start and finish of each casting operation, as well as to adjust the metal level during the casting operation.

4. The device in accordance with claim 3, wherein the metal level in the channels is adjusted on the basis of a detected metal height using a level detector arranged over the first and second supply channels between the metal locks.

5. The device in accordance with claim 2, wherein on each side of the metal lifting container in connection with the first and second supply channels, metal locks are arranged to shut off or adjust the metal throughflow and the level in the first and second supply channels in connection with the start and finish of each casting operation, as well as to adjust the metal level during the casting operation.

6. The device in accordance with claim 3, wherein the metal level in the first and second supply channels is adjusted on the basis of a detected metal height using a level detector arranged over the first and second supply channels between the metal locks.

7. The device in accordance with claim 3, wherein the metal level in the first and second supply channels is adjusted on the basis of a detected metal height using a level detector arranged over the first and second supply channels between the metal locks.

8. The device in accordance with claim 1, wherein the at least one mold comprises a plurality of molds.

* * * * *